US007828160B2

(12) United States Patent
Lin

(10) Patent No.: US 7,828,160 B2
(45) Date of Patent: Nov. 9, 2010

(54) STORAGE RACK

(75) Inventor: Yu-Teng Lin, Taya Hsiang (TW)

(73) Assignee: Chuang-Chih Chiang, Taichung County (TW)

( * ) Notice: Subject to any disclaimer, the term of this patent is extended or adjusted under 35 U.S.C. 154(b) by 330 days.

(21) Appl. No.: 12/155,858

(22) Filed: Jun. 11, 2008

(65) Prior Publication Data

US 2009/0308825 A1 Dec. 17, 2009

(51) Int. Cl.
*A47F 5/14* (2006.01)

(52) U.S. Cl. ..... 211/181.1

(58) Field of Classification Search ..... 211/181.1, 211/74, 126.8, 126.9, 133.2, 133.5, 41.4, 211/85.31, 90.03, 106, 112, 119; 248/153, 248/175, 302; 220/491; D6/458, 462, 566
See application file for complete search history.

(56) References Cited

U.S. PATENT DOCUMENTS

D162,925 S * 4/1951 Berkowitz ..... D6/462
2,558,611 A * 6/1951 Emmart ..... 211/74
3,848,748 A * 11/1974 Ceccarelli ..... 211/195
3,858,835 A * 1/1975 Baren ..... 248/94
3,905,286 A * 9/1975 Le Grady ..... 99/450
4,248,397 A * 2/1981 Casper ..... 248/138
4,572,379 A * 2/1986 Wallo ..... 211/57.1
4,930,642 A * 6/1990 Brooks et al. ..... 211/85.31
5,435,295 A * 7/1995 Gerrard ..... 126/541
5,503,062 A * 4/1996 Buff, IV ..... 99/426
6,047,932 A * 4/2000 Skvorecz ..... 248/153
6,234,068 B1 * 5/2001 Sherman ..... 99/449
6,318,570 B1 * 11/2001 Mueller et al. ..... 211/181.1
6,520,354 B1 * 2/2003 Skvorecz ..... 211/181.1
D485,706 S * 1/2004 O'Connell Cooper et al. ..... D6/462
6,997,329 B2 * 2/2006 Ohanian ..... 211/41.11
7,281,469 B1 * 10/2007 Barbour et al. ..... 99/426
7,340,859 B2 * 3/2008 Palsrok ..... 47/39
7,469,792 B1 * 12/2008 Lin ..... 211/74
7,520,397 B1 * 4/2009 Segale ..... 211/106
2003/0034318 A1 * 2/2003 Skvorecz ..... 211/181.1
2004/0238467 A1 * 12/2004 Tully ..... 211/74
2005/0218274 A1 * 10/2005 Skvorecz ..... 248/153
2005/0269277 A1 * 12/2005 Su ..... 211/74
2007/0205171 A1 * 9/2007 Iwata ..... 211/181.1
2009/0020491 A1 * 1/2009 Foster ..... 211/181.1

* cited by examiner

*Primary Examiner*—Jennifer E. Novosad
(74) *Attorney, Agent, or Firm*—Rosenberg, Klein & Lee

(57) ABSTRACT

A storage rack a base frame rod structure formed by bending one single metal wire rod into a predetermined shape and a top frame rod structure formed by bending one single metal wire rod into a predetermined shape and welded to the base frame rod structure such that multiple storage racks can be received together by inserting one storage rack of another storage rack to save storage space, or multiple storage racks can be stacked together, constituting a multi-deck combination storage rack.

3 Claims, 4 Drawing Sheets

STORAGE RACK

BACKGROUND OF THE INVENTION

1. Field of the Invention

The present invention relates to racks and more particularly, to a storage rack that allows multiple storage racks to be received together, saving storage space.

2. Description of the Related Art

A typical bottle rack is made by means of fastening metal wire rods and/or metal frame members together subject to the desired shape by means of welding. A bottle rack of this type is not collapsible. There is known a detachable bottle rack made by means of fastening metal wire rods and/or metal frame members together with screws subject to the desired shape. When mounting or dismounting this design of bottle rack, a screwdriver must be used.

SUMMARY OF THE INVENTION

It is one object of the present invention to provide a storage rack, which allows multiple storage racks to be received together by inserting one storage rack of another storage rack to save storage space. It is another object of the present invention to provide a storage rack, which allows multiple storage racks to be stacked together, constituting a multi-deck combination storage rack.

To achieve these and other objects of the present invention, the storage rack comprises a base frame rod structure and a top frame rod structure. The base frame rod structure comprises two symmetrical pairs of foot rod portions, two horizontal top rod portions transversely arranged in parallel at two first opposite sides and respectively connected between top ends of the foot rod portions, and two stretcher rod portions longitudinally arranged in parallel at two second opposite sides perpendicular to the first opposite sides and respectively connected between bottom ends of the foot rod portions. The two foot rod portions of one same pair are kept in a sloping status such that the distance between the two ends of the two foot rod portions is smaller than the distance between the bottom ends thereof. The top frame rod structure comprises two longitudinal rod portions respectively spaced above the stretcher rod portions in a parallel member, two transverse rod portions respectively connected between and formed integral with two opposite ends of the two longitudinal rod portions and respectively welded to the foot rod portions of the base frame rod structure at an elevation below the horizontal top rod portions. The longitudinal rod portions are disposed at an elevation above the transverse rod portions so that a gap is defined between the top frame rod structure and each foot rod portion in each of the four corners of the storage rack.

DETAILED DESCRIPTION OF THE PREFERRED EMBODIMENT

Figure 1:
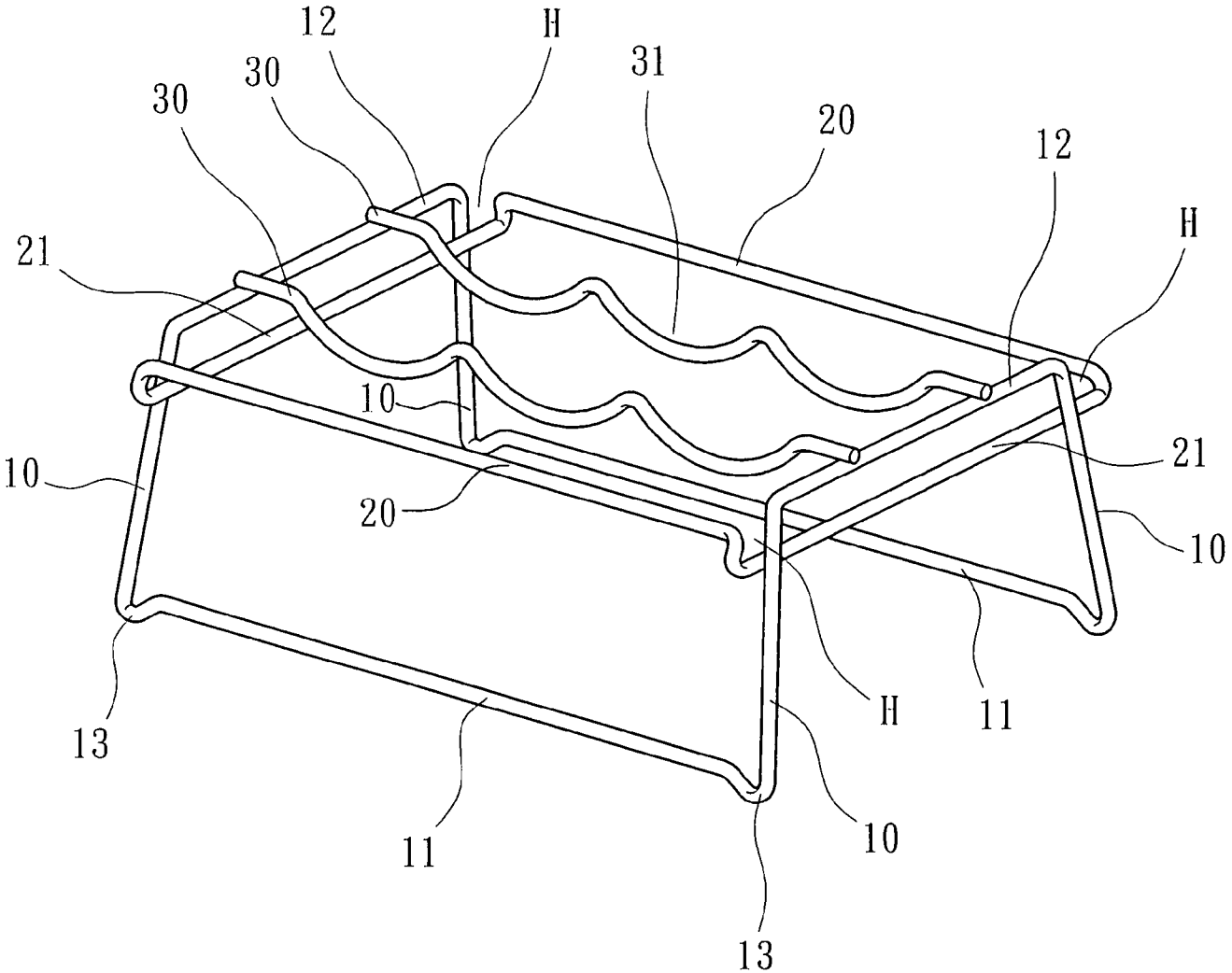
FIG. 1 is an elevational view of a storage rack in accordance with a first embodiment of the present invention.

Referring to FIG. 1, a storage rack in accordance with a first embodiment of the present invention is shown comprised of a base frame rod structure and a top frame rod structure. The base frame rod structure comprises two symmetrical pairs of foot rod portions 10, two horizontal top rod portions 12 transversely arranged in parallel at two first opposite sides and respectively connected between the top ends of the foot rod portions 10, and two stretcher rod portions 11 longitudinally arranged in parallel at two second opposite sides perpendicular to the first opposite sides and respectively connected between the bottom ends of the foot rod portions 10. The stretcher rod portions 11 are disposed at an elevation slightly above the bottom ends of the foot rod portions 10 so that each stretcher rod portion 11 has each end terminating in a downwardly curved protruding portion 13 that connects to the bottom end of one foot rod portion 10. Further, the two foot rod portions 10 of one same pair slope are kept in a sloping status such that the distance between the two ends of the two foot rod portions 10 is smaller than the distance between the bottom ends thereof. The top frame rod structure comprises two longitudinal rod portions 20 respectively spaced above the stretcher rod portions 11 in a parallel member, two transverse rod portions 21 respectively connected between and formed integral with the two opposite ends of the two longitudinal rod portions 20 and respectively welded to the foot rod portions 10 of the base frame rod structure at an elevation below the horizontal top rod portions 12. The longitudinal rod portions 20 are disposed at an elevation slightly above the transverse rod portions 21 so that a gap H is defined between the top frame rod structure and each foot rod portion 10 in each of the four corners of the bottle rack. According to this design, the storage rack is a bottle rack.

Further, two supplementary bearing rods 30 are fixedly connected between the two horizontal top rod portions 12 and arranged in parallel, each having a longitudinal series of wave-like portions 31.

Figure 2:
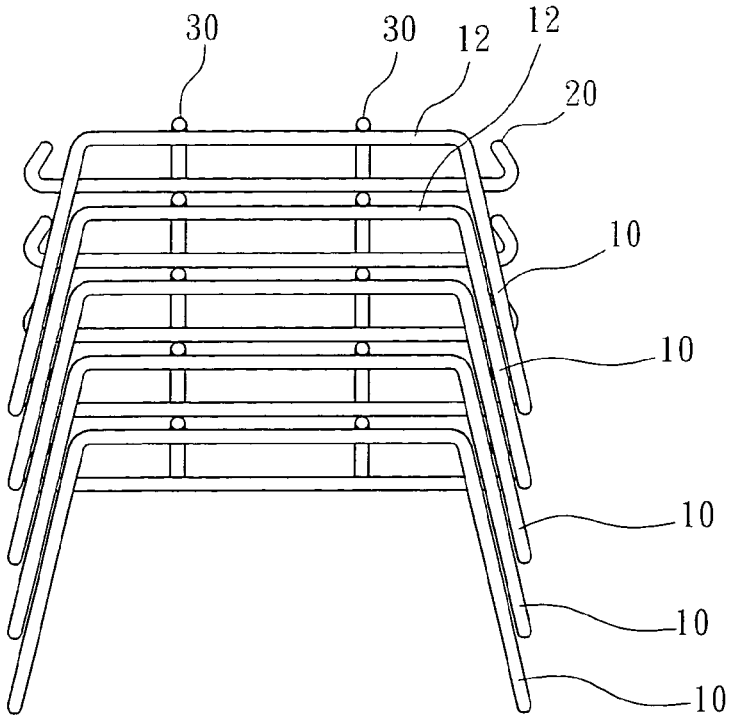
FIG. 2 is a schematic drawing showing multiple storage racks of the first embodiment of the present invention received together.

Referring to FIG. 2, multiple storage racks can be stacked together, saving storage space.

Figure 3:
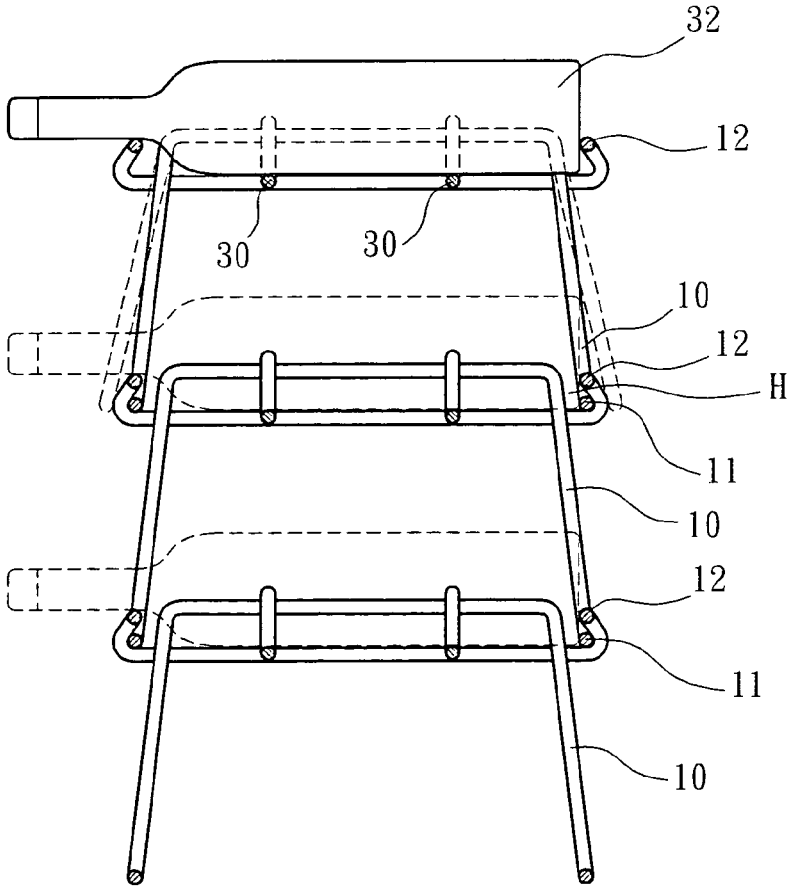
FIG. 3 is a schematic drawing showing a multi-deck combination storage rack formed of multiple storage racks of the first embodiment of the present invention.

Referring to FIG. 3, the foot rod portions 10 of one storage rack can be forced inwards in transverse direction to have the stretcher rod portions 11 of the storage rack be engaged into the gaps H defined between the top frame rod structure and the foot rod portions 10 in the four corners of another storage rack. Therefore, multiple storage (bottle) racks can be arranged together, constituting a multi-deck combination storage rack. When multiple storage racks are arranged together to constitute a multi-deck combination storage rack, the downwardly curved protruding portions 13 of one upper storage rack are respectively clamped on the transverse rod portions 21 of one lower storage rack, enhancing the connection stability.

Figure 4:
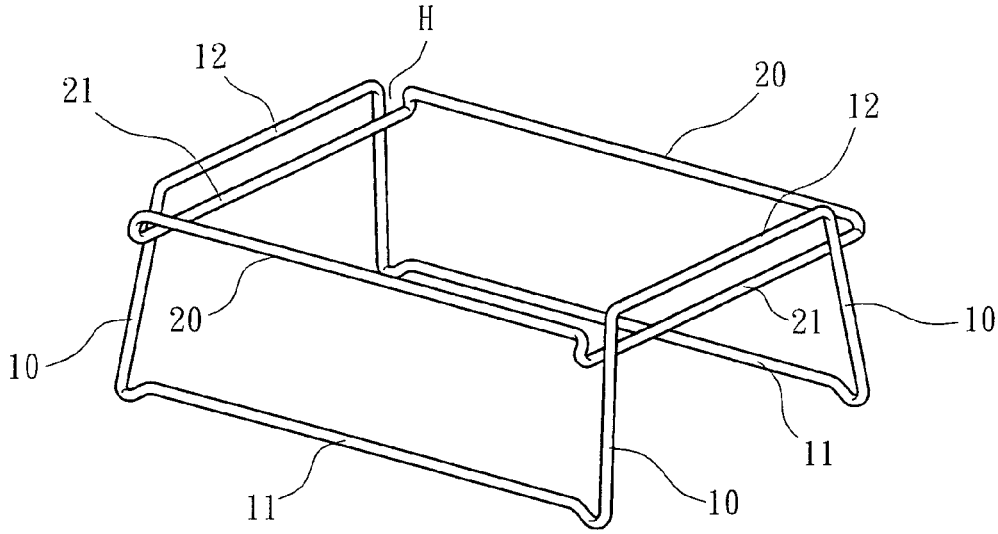
FIG. 4 is an elevational view of a storage rack in accordance with a second embodiment of the present invention.
Figure 5:
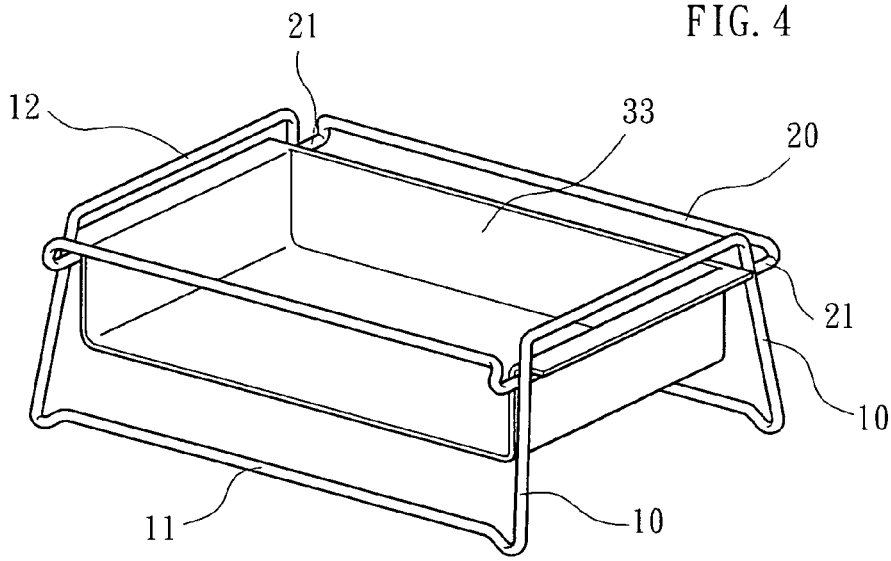
FIG. 5 corresponds to FIG. 4, showing a storage box fastened to the transverse rod portions of the storage rack.
Figure 6:
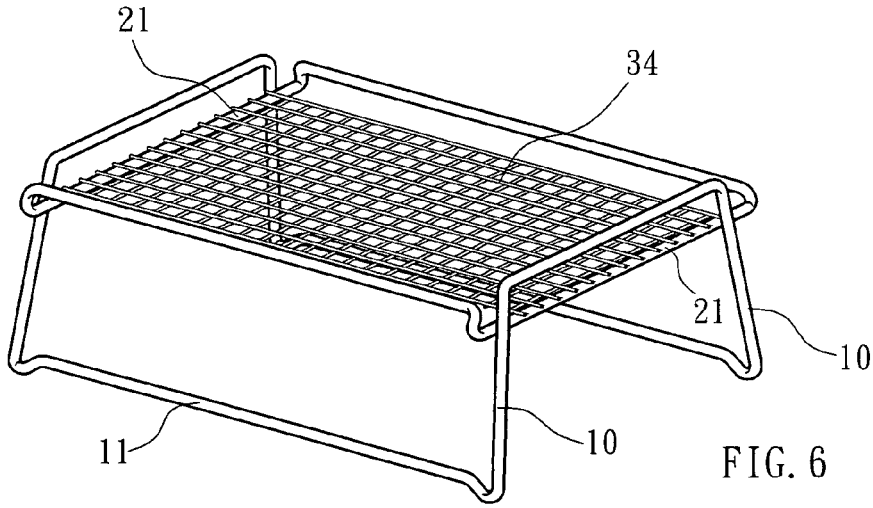
FIG. 6 corresponds to FIG. 4, showing a latticed sheet member fastened to the transverse rod portions of the storage rack.

FIG. 4 shows a storage rack in accordance with a second embodiment of the present invention. This embodiment eliminates the aforesaid supplementary bearing rods 30. Further, a storage box 33 (see FIG. 5) or latticed sheet member 34 can be fastened the transverse rod portions 21 for holding things.

Figure 7:
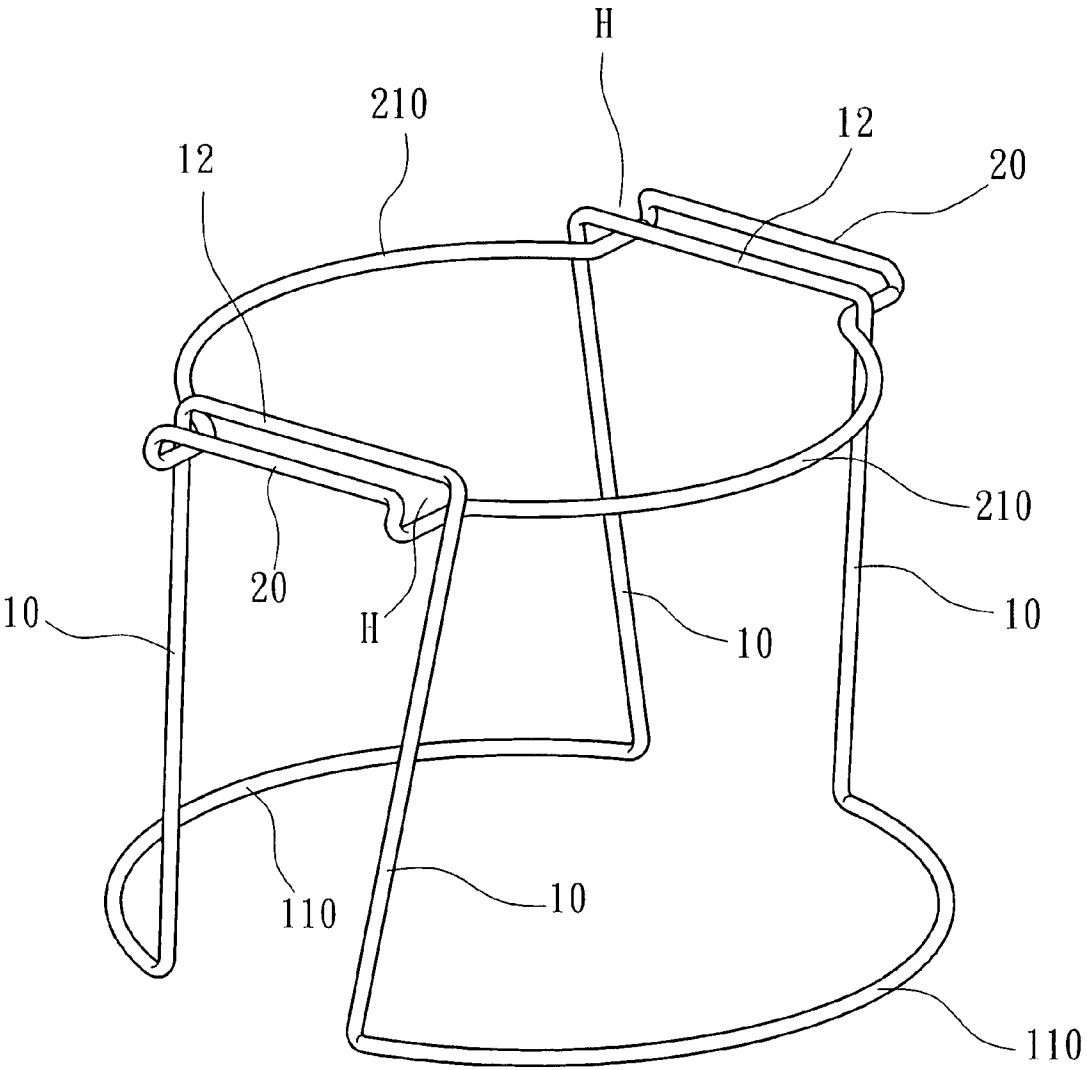
FIG. 7 is an elevational view of a storage rack in accordance with a third embodiment of the present invention.

FIG. 7 shows a storage rack in accordance with a third embodiment of the present invention. This embodiment is based on the design of the aforesaid second embodiment shown in FIG. 4 with the exception that the stretcher rod portions 110 and the transverse rod portions 210 are smoothly arched.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A storage rack comprising a base frame rod structure, said base frame rod structure comprising two symmetrical pairs of foot rod portions, two horizontal top rod portions transversely arranged in parallel at two first opposite sides and respectively connected between top ends of said foot rod portions, and two stretcher rod portions longitudinally arranged in parallel at two second opposite sides perpendicular to said first opposite sides and respectively connected between bottom ends of said foot rod portions, the two foot rod portions of one same pair being kept in a sloping status such that the distance between the top ends of the two foot rod portions is smaller than the distance between the bottom ends thereof; and a top frame rod structure, said top frame rod structure comprising two longitudinal rod portions respectively spaced above said stretcher rod portions in a parallel manner, two transverse rod portions respectively connected between and formed integral with two opposite ends of said two longitudinal rod portions and respectively welded to the foot rod portions of said base frame rod structure at an elevation below said horizontal top rod portions, said longitudinal rod portions being disposed at an elevation above said transverse rod portions so that a gap is defined between said top frame rod structure and each said foot rod portion in each of four corners of the storage rack.

2. The storage rack as claimed in claim 1, further comprising two supplementary bearing rods fixedly connected between said two horizontal top rod portions and arranged in parallel, each said supplementary bearing rod having a longitudinal series of wave-like portions.

3. The storage rack as claimed in claim 1, as claimed in claim 1, wherein said stretcher rod portions being disposed at an elevation above the bottom ends of said foot rod portions so that each stretcher rod portion has each end thereof terminating in a downwardly curved protruding portion that connects to the bottom end of one said foot rod portion.

* * * * *